US008546053B2

(12) United States Patent
Kusahara et al.

(10) Patent No.: US 8,546,053 B2
(45) Date of Patent: Oct. 1, 2013

(54) TONER, AND PRODUCTION METHOD OF THE SAME

(75) Inventors: Teruki Kusahara, Numazu (JP); Junichi Awamura, Numazu (JP); Tomomi Suzuki, Namazu (JP); Toshihiko Karato, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 858 days.

(21) Appl. No.: 12/555,378

(22) Filed: Sep. 8, 2009

(65) Prior Publication Data

US 2010/0062352 A1 Mar. 11, 2010

(30) Foreign Application Priority Data

Sep. 8, 2008 (JP) ..... 2008-229444

(51) Int. Cl.
*G03G 9/00* (2006.01)

(52) U.S. Cl.
USPC ..... 430/108.1; 430/105; 430/137.1; 430/110.2

(58) Field of Classification Search
USPC ..... 430/104, 48, 37.15, 109.4, 108.1–108.8, 430/110.2
See application file for complete search history.

(56) References Cited

U.S. PATENT DOCUMENTS 5,403,690 A 4/1995 Kuramoto et al.
5,554,478 A 9/1996 Kuramoto et al.
5,840,456 A 11/1998 Tomita et al.
5,935,751 A * 8/1999 Matsuoka et al. ..... 430/108.8
6,074,794 A 6/2000 Fushimi et al.
6,303,258 B1 10/2001 Katoh et al.
6,406,826 B1 6/2002 Suzuki et al.
6,500,595 B1 12/2002 Mochizuki et al.
6,757,507 B2 6/2004 Mochizuki et al.
6,770,411 B2 8/2004 Masuda et al.
6,818,369 B2 11/2004 Sugiura et al.
6,828,075 B2 12/2004 Suzuki et al.
6,861,191 B2 3/2005 Mochizuki et al.
6,902,857 B2 6/2005 Yagi et al.
7,024,140 B2 4/2006 Masuda et al.
7,083,890 B2 8/2006 Emoto et al.
7,129,013 B2 10/2006 Higuchi et al.
7,169,522 B2 1/2007 Sugiura et al.

(Continued)

FOREIGN PATENT DOCUMENTS

JP 5-61242 3/1993
JP 8-220808 8/1996

(Continued)

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

The present invention provides a method for producing a toner, the method including: preparing a wax dispersion liquid by cooling a wax solution, in which a wax is heated and dissolved or dispersed in an organic solvent, in a container so that a standard deviation σ of a temperature distribution between a center portion of the container and an inner wall of the container is 0.5 or less and the cooling rate is 2.0° C./min or more, to precipitate wax particles in the wax solution; forming toner base precursor particles by adding an aqueous phase containing resin fine particles into an oil phase containing at least the wax dispersion liquid, a colorant and a binder resin and mixing the oil phase and the aqueous phase with each other; and preparing toner base particles by removing the solvent from the toner base precursor particles.

16 Claims, 2 Drawing Sheets

(56) References Cited

U.S. PATENT DOCUMENTS

| | | | | |
|---|---|---|---|---|
| 7,300,737 | B2 * | 11/2007 | Ayaki et al. | 430/137.15 |
| 7,344,812 | B2 | 3/2008 | Suzuki et al. | |
| 7,374,851 | B2 | 5/2008 | Nakayama et al. | |
| 7,429,442 | B2 | 9/2008 | Honda et al. | |
| 7,437,111 | B2 | 10/2008 | Yamada et al. | |
| 7,473,508 | B2 | 1/2009 | Higuchi et al. | |
| 7,504,188 | B2 | 3/2009 | Yamada et al. | |
| 7,521,164 | B2 | 4/2009 | Nakayama et al. | |
| 7,587,161 | B2 | 9/2009 | Yamada et al. | |
| 2004/0197692 | A1 * | 10/2004 | Yamane et al. | 430/108.6 |
| 2005/0112488 | A1 | 5/2005 | Yamada et al. | |
| 2007/0218380 | A1 | 9/2007 | Uchinokura et al. | |
| 2007/0218381 | A1 | 9/2007 | Uchinokura et al. | |
| 2007/0218382 | A1 * | 9/2007 | Emoto et al. | 430/108.1 |
| 2007/0218383 | A1 | 9/2007 | Seshita et al. | |
| 2007/0218385 | A1 * | 9/2007 | Kojima et al. | 430/108.1 |
| 2008/0070148 | A1 | 3/2008 | Awamura et al. | |
| 2008/0076055 | A1 | 3/2008 | Sawada et al. | |
| 2008/0096116 | A1 * | 4/2008 | Utsumi et al. | 430/48 |
| 2008/0096119 | A1 * | 4/2008 | Yamamoto et al. | 430/109.4 |
| 2008/0199797 | A1 * | 8/2008 | Sacripante et al. | 430/104 |
| 2008/0213682 | A1 | 9/2008 | Saitoh et al. | |
| 2008/0227015 | A1 | 9/2008 | Nagatomo et al. | |
| 2008/0227018 | A1 | 9/2008 | Awamura et al. | |
| 2008/0280218 | A1 | 11/2008 | Sabu et al. | |
| 2008/0280219 | A1 | 11/2008 | Nakayama et al. | |
| 2008/0292361 | A1 | 11/2008 | Seshita et al. | |
| 2008/0311500 | A1 | 12/2008 | Yamada et al. | |
| 2009/0010687 | A1 | 1/2009 | Yamada et al. | |
| 2009/0017392 | A1 | 1/2009 | Higuchi et al. | |
| 2009/0061345 | A1 | 3/2009 | Yamada et al. | |
| 2009/0067876 | A1 | 3/2009 | Seshita et al. | |
| 2009/0117480 | A1 | 5/2009 | Yamada et al. | |
| 2009/0142093 | A1 | 6/2009 | Sawada et al. | |
| 2009/0142094 | A1 | 6/2009 | Sawada et al. | |
| 2009/0142680 | A1 | 6/2009 | Shimota et al. | |
| 2009/0142682 | A1 | 6/2009 | Saitoh et al. | |
| 2009/0142690 | A1 | 6/2009 | Awamura et al. | |
| 2009/0155709 | A1 | 6/2009 | Watanabe et al. | |
| 2009/0214975 | A1 | 8/2009 | Awamura et al. | |

FOREIGN PATENT DOCUMENTS

| | | |
|---|---|---|
| JP | 9-106105 | 4/1997 |
| JP | 9-304964 | 11/1997 |
| JP | 10-0293425 | 11/1998 |
| JP | 2009-134083 | 6/2009 |

* cited by examiner

TONER, AND PRODUCTION METHOD OF THE SAME

BACKGROUND OF THE INVENTION

1. Field of the Invention

The present invention relates to an electrostatic image developing toner used in a developer for developing electrostatic images in electrophotography, electrostatic recording, electrostatic printing and the like, and also relates to a production method of the toner. More specifically, the present invention relates to an electrostatic image developing toner used in copiers, laser printers, plain paper facsimiles etc. using a direct or indirect electrophotographic developing system, and also relates to a production method of the toner.

2. Description of the Related Art

There has been a strong market demand for achieving high-quality image formation on electrophotographic apparatuses. Accordingly, developments have been made to make toner responsive to the demand for forming high quality images. In order to make toner responsive to achieving high-quality image formation, uniformization of toner particle size is an indispensable prerequisite. When a toner is made to have uniform toner particle size and a sharp particle size distribution, behaviors of individual toner particles are substantially uniformized, resulting in a remarkable improvement in microdot reproducibility.

In color-image formations using a full-color electrophotographic process, generally, three color toners of yellow, magenta and cyan colors, or four color toners of black color toner in addition to the three color toners are mixed to reproduce all colors. Thus, in order to obtain a sharp full-color image excellent in color-reproducibility, it is necessary to smooth the surface of a fixed toner image to some extent so as to reduce light scattering. For this reason, as to image glosses obtained by conventional full-color copiers etc., images having a middle glossiness to a high-glossiness of 10% to 50% have been often formed.

Generally, as a method of fixing a dry-toner image on a recording medium, the contact-heating fixing method is often employed in which a roller or belt having a smooth surface is press-contact with toner while heating the roller or belt. This method has advantages in that it exhibits high-thermal efficiency, enables high-speed fixing and enables color toners to have glossiness and transparency. On the other hand, this method inconveniently causes a so-called offset phenomenon in which a part of a toner image adheres to the surface of a fixing roller and then transferred onto another image, because a surface of a heat-fixing member is made in contact with a molten toner under application of pressure and then they are separated from each other.

With a view to preventing the offset phenomenon, there has been carried out a method of forming a surface layer of a fixing roller with use of a material excellent in releasing property, such as a silicone rubber and a fluorine resin, and further applying a releasing oil, such as a silicone oil, onto the surface layer of the fixing roller. This method is extremely effective in preventing toner-offset.

However, this method requires additionally providing a device for supplying a releasing oil, leasing to upsizing the fixing device and high costs.

With respect to monochrome toners, a method is employed in which a molecular weight distribution of a binder resin is adjusted so as to increase the viscoelasticity of a molten toner and to avoid internal fracture of the molten toner, and further, a releasing agent such as a wax is incorporated into the toner so that no releasing oil is applied to a fixing roller or the amount of oil applied thereto is reduced to a very small amount.

As described above, however, in use of a color toner, there is a need to smooth the surface of a fixed image in order to improve the color reproducibility, and thus to reduce the viscoelasticity of the toner in a molten state. Therefore, color toners can more easily cause the offset phenomenon than monochrome toners, which have less glossiness, and it becomes more difficult to employ oil-less fixing method on a fixing device and to apply a very small amount of oil to a fixing device. When a releasing agent is incorporated into a toner, the adhesive strength of the toner is increased, so that the transferability of the toner to a transfer paper degrades, and further, the releasing agent in the toner contaminates a frictional charging member such as a carrier, which causes degradation in chargeability, resulting in degradation in durability of the toner.

For instance, Japanese Patent Application Laid-Open (JP-A) No. 8-220808 proposes a toner using a linear polyester resin having a softening point of 90° C. to 120° C. and a carnauba wax. Japanese Patent Application Laid-Open (JP-A) No. 9-106105 proposes a toner using resins which are soluble with each other and have a different softening point, and a wax. Japanese Patent Application Laid-Open (JP-A) No. 9-304964 proposes a toner using a polyester resin and a wax having a specified melt-viscosity. Japanese Patent Application Laid-Open (JP-A) No. 10-293425 proposes a toner using a polyester resin having a softening point of 90° C. to 120° C., a rice wax, a carnauba wax and a silicone oil. Furthermore, Japanese Patent Application Laid-Open (JP-A) No. 5-61242 discloses a wax-incorporated toner which is produced by polymerization.

The above-mentioned toners, however, are not toners having sufficient offset resistance while maintaining a moderate glossiness, even used in a fixing method where no releasing oil is applied to a fixing roller or the amount of oil applied thereto is reduced to a very small amount, and excellent in transferability, durability, charging stability against humidity and pulverizability.

The releasing property of toner is greatly affected by the dispersion state of wax in a binder resin. When the wax is mutually soluble in the binder resin, the wax does not exhibit its essential melting capability and thus cannot exhibit its releasing property. The offset resistance of toner can be improved only by allowing the wax to exist as domains in the binder resin.

Accordingly, it is advantageous in terms of improving the offset resistance of toner to use a wax poor in solubility with binder resins. The poorer the mutual solubility between a binder resin and a wax, the larger is the dispersion diameter of the wax domains. When the dispersion diameter of wax is large, the amount ratio of wax residing close to the surface of toner particles is relatively increased, and the wax component easily exude to the surface of the toner, which is beneficial in terms of the offset resistance.

However, when the wax is easily exposed to the surface of the toner, the wax and carrier moves toward the photoconductor, causing filming at the photoconductor. Further, when the wax moves to the carrier and the like, it causes aggregation of toner particles, resulting in degradation in flowability of the toner.

As described above, when the dispersion diameter of the wax is increased so as to increase the amount ratio of wax residing close to the surface of toner particles, the offset resistance is improved, but on the other hand, which brings about new problems of preventing formation of high-quality images, such as filming and aggregation of tone particles.

Note that when wax components are exposed from the surface of the toner in formation of toner particles in an aqueous medium, it causes aggregation of the toner particles, which adversely affects a particle size distribution of the toner.

In order to prevent the adverse affect of the wax exposed from the surface of toner, as mentioned above, a toner having a capsulated structure (capsulate toner) has been proposed. Since this capsulate toner has a core layer composed of wax and a shell layer which covers the core layer and which is composed of a binder resin, wax components are prevented from being exposed from the surface of toner particles. In other words, a capsulate toner can prevent the occurrence of filming and aggregation of toner particles.

However, this capsulate toner has a structure that wax components are tightly covered with the shell layer, and thus this capsulate toner requires much more energy and longer time to allow the wax components exude from the inside of toner than conventional toners containing wax components, so that it is sometimes unable to obtain satisfactory releasing property.

BRIEF SUMMARY OF THE INVENTION

An object of the present invention is to provide a method for producing a toner which has moderate glossiness and sufficient offset resistance and which is excellent in transferability, durability, charging stability against humidity and pulverizability, and also relates to a toner produced by the method for producing a toner.

Means for solving the problems in related art are as follows:

<1> A method for producing a toner which contains at least a colorant, a binder resin and toner base particles containing a wax, the method including:

preparing a wax dispersion liquid by cooling a wax solution, in which the wax is heated and dissolved or dispersed in an organic solvent, in a container so that a standard deviation σ of a temperature distribution between a center portion of the container and an inner wall of the container is 0.5 or less and the cooling rate is 2.0° C./min or more, to precipitate wax particles in the wax solution, forming toner base precursor particles, which are precursors of toner base particles, by adding an aqueous phase containing resin fine particles into an oil phase containing at least the wax dispersion liquid, the colorant and the binder resin and mixing the oil phase and the aqueous phase with each other, and preparing toner base particles by removing the solvent from the toner base precursor particles to thereby obtain toner base particles.

<2> The method for producing a toner according to <1>, wherein in the preparation of a wax dispersion liquid, the wax dispersion liquid is obtained using an agitator provided with agitation paddles which constantly makes contact with the inner wall of the container.

<3> The method for producing a toner according to <1>, wherein a circle area-corresponding number average particle diameter D of the wax particles satisfies the following relationship, 0.50 μm<D<0.70 μm.

<4> The method for producing a toner according to <1>, wherein the toner base particles have a volume average particle diameter Dv of 3.0 μm to 7.0 μm.

<5> The method for producing a toner according to <1>, wherein a ratio Dv/Dn of the volume average particle diameter Dv to a number average particle diameter Dn is 1.20 or less.

<6> The method for producing a toner according to <1>, wherein the binder resin contains a polyester resin.

<7> The method for producing a toner according to <6>, wherein the amount of the polyester resin contained in the binder resin is 50% by mass to 98% by mass.

<8> The method for producing a toner according to <6>, wherein a mass average molecular weight of the tetrahydrofuran-soluble matter of the polyester resin is 1,000 to 30,000.

<9> The method for producing a toner according to <6>, wherein the polyester resin is an acid group-containing polyester resin, and the acid group-containing polyester resin has an acid value of 1.0 mgKOH/g to 50.0 mgKOH/g.

<10> The method for producing a toner according to <9>, wherein the acid group-containing polyester resin has a glass transition temperature of 35° C. to 65° C.

<11> The method for producing a toner according to <1>, wherein a precursor of the binder resin is composed of a polymer having sites capable of reacting with a compound having an active hydrogen-containing group, and the polymer has a mass average molecular weight of 3,000 to 20,000.

<12> The method for producing a toner according to <1>, wherein the toner base particles have an acid value of 0.5 mgKOH/g to 40.0 mgKOH/g.

<13> The method for producing a toner according to <1>, wherein the toner base particles have a glass transition temperature of 40° C. to 70° C.

<14> A toner obtained by a method for producing a toner, the toner containing: toner base particles containing at least a colorant, a binder resin and a wax, wherein the method for producing a toner includes:

preparing a wax dispersion liquid by cooling a wax solution, in which the wax is heated and dissolved or dispersed in an organic solvent, in a container so that a standard deviation σ of a temperature distribution between a center portion of the container and an inner wall of the container is 0.5 or less and the cooling rate is 2.0° C./min or more, to precipitate wax particles in the wax solution, forming toner base precursor particles, which are precursors of toner base particles, by adding an aqueous phase containing resin fine particles in an oil phase containing at least the wax dispersion liquid, the colorant and the binder resin and mixing the oil phase and the aqueous phase with each other, and preparing toner base particles by removing the solvent from the toner base precursor particles to thereby obtain toner base particles.

The present invention can provide a method for producing a toner which has moderate glossiness and sufficient offset resistance and which is excellent in transferability, durability, charging stability against humidity and pulverizability, and an electrostatic image developing toner produced by the method for producing a toner.

DETAILED DESCRIPTION OF THE INVENTION (Toner)

Figure 1:
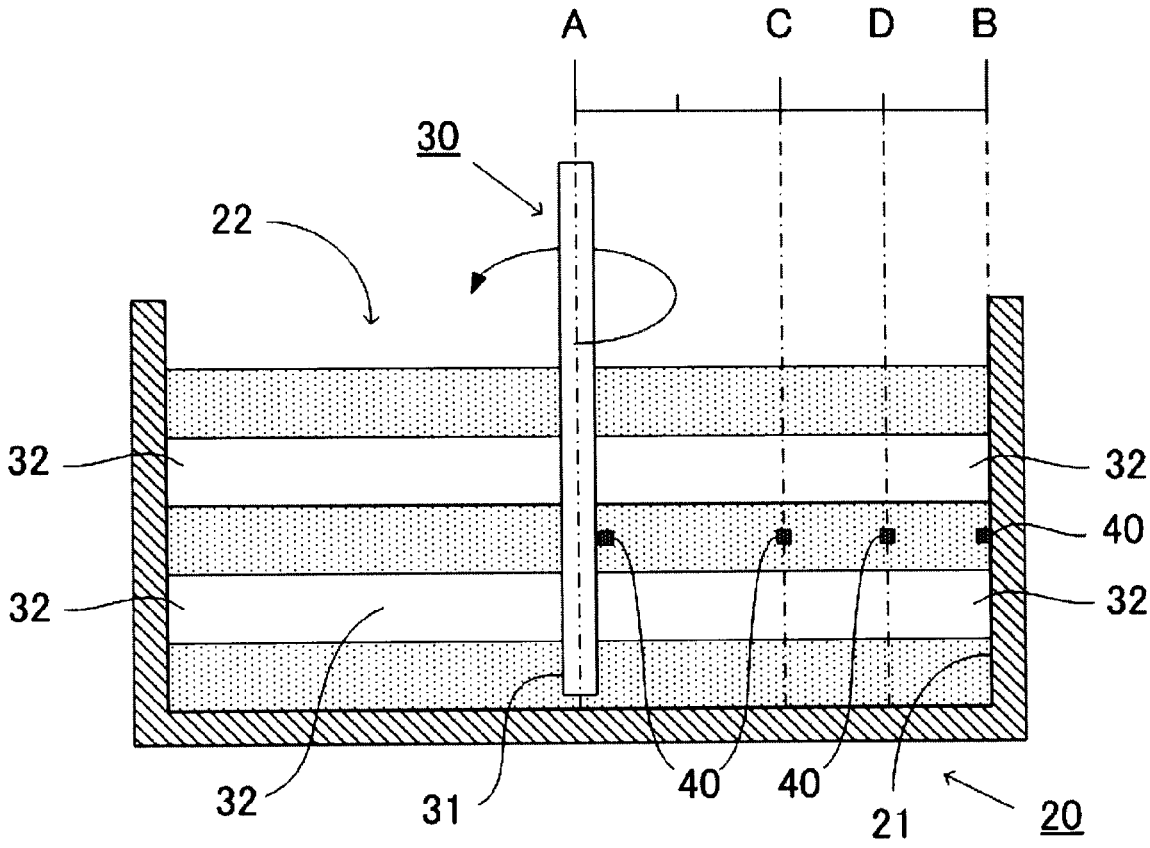
FIG. 1 is an explanatory diagram schematically showing a cross-section of a container for cooling a wax solution.

The toner of the present invention contains toner base particles including at least a colorant, a binder resin and a wax, contains external additives, and further contains other components in accordance with the necessity.

<Binder Resin>

The binder resin can be selected from known resins. Examples of the binder resin include polymers derived from monomers of styrene, parachlorostyrene, vinyl toluene, vinyl chloride, vinyl acetate, vinyl propionate, methyl (meth)acrylate, ethyl (meth)acrylate, propyl (meth)acrylate, n-butyl (meth)acrylate, isobutyl (meth)acrylate, dodecyl (meth)acrylate, 2-ethylhexyl (meth)acrylate, lauryl (meth)acrylate, 2-hydroxyethyl (meth)acrylate, hydroxypropyl (meth)acrylate, 2-chloroethyl (meth)acrylate, (meth)acrylonitrile, (meth)acrylamide, (meth)acrylic acid, vinyl methyl ether, vinyl ethyl ether, vinyl isobutyl ether, vinyl methyl ketone, N-vinyl pyrrolidone, N-vinyl pyridine, butadiene and the like; or copolymers composed of two or more selected from these monomers; or mixtures thereof.

Besides the above mentioned, a polyester resin, polyol resin, polyurethane resin, polyamide resin, epoxy resin, rosin, modified rosin, terpene resin, phenol resin, hydrogenated petroleum resin etc. may be used alone or in the form of a mixture of two or more thereof.

As the binder resin, especially preferred are polyester resins which have low-temperature fixability.

Examples of the polyester resins include, for example, acid group-containing polyester resins, i.e. polyester resins having an acidic group, such as a carboxylic acid group and a sulfonic acid group.

The mass average molecular weight of the THF-soluble (tetrahydrofuran-soluble) matter of the acid group-containing polyester resin is preferably 1,000 to 30,000, from the viewpoint of the heat resistant storage stability, low-temperature fixability, offset resistance and the like. When the mass average molecular weight of the THF-soluble matter is less than 1,000, the heat resistant storage stability of the resulting toner may degrade due to an increased amount of oligomer components of the acid group-containing resin. When it is more than 30,000, the acid group-containing polyester resin causes a steric hindrance, whereby the prepolymer modification effects will be insufficient, which may result in degradation of the offset resistance.

Note that in the present invention, the mass average molecular weight of a polymer such as a binder resin is measured by GPC (Gel Permeation Chromatography) according to the following method.

A column is stabilized in a 40° C. heat chamber, tetrahydrofuran (THF) as a solvent is allowed to flow into the column at the temperature at a flow rate of 1 ml/min, and about 50 μl to about 200 μl of a THF sample solution of a binder resin having a sample concentration adjusted to 0.05% by mass to 0.6% by mass are injected for measurement.

In measuring the molecular weight of the sample, the molecular weight distribution possessed by the sample is calculated from a relationship between a logarithmic value of an analytical curve prepared by several kinds of monodisperse polystyrene standard samples and the number of counts (retention time). Examples of available standard polystyrene samples for preparing an analytical curve include samples manufactured by Pressure Chemical Co. or by Tosoh Corporation each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ or $4.48\times10^6$. At least about ten standard polystyrene samples are suitably used. A refractive index (RI) detector is used as a detector.

The particle size and the physical properties of a toner into which a basic compound is added, such as low-temperature fixability, high-temperature offset resistance, heat resistant storage stability and charging stability, can be controlled at high-grades by adjusting the acid value of the acidic group-containing polyester resin to 1.0 mgKOH/g to 50.0 mgKOH/g.

When the acid value of the acid group-containing polyester resin is more than 50.0 mgKOH/g, an elongation or crosslinking reaction of the modified polyester proceeds inadequately, and the high-temperature offset resistance of the resulting toner may degrade. When the acid value is less than 1.0 mgKOH/g, the dispersion stability effect of the basic compound cannot be obtained in production of toner, and the elongation or crosslinking reaction of the modified polyester easily proceeds, resulting in degradation of the stability in production.

The acid value of the polyester resin is measured according to the measurement method specified in JIS K0070.

The binder resin may be used in the form of a precursor, such as a modified prepolymer, at the time of preparing toner base particles.

As the precursor, for example, there may be exemplified a reactive modified polyester resin which reacts with a crosslinking agent and/or an elongating agent to form a crosslinked and/or elongated structure. The reactive modified polyester resin has a functional group which is reactive with active hydrogen.

As the reactive modified polyester resin (RMPE) which is reactive with active hydrogen, a polyester prepolymer (A) having an isocyanate group is exemplified.

As the prepolymer (A), there may be exemplified a polyester prepolymer obtained by reacting further with a polyisocyanate (PIC) a polyester which is a polycondensate of a polyol (PO) and a polycarboxylic acid (PC) and has an active hydrogen-containing group.

Examples of active-hydrogen-containing group possessed by the polyester include a hydroxyl group (alcoholic hydroxyl group and phenolic hydroxyl group), an amino group, a carboxyl group and a mercapto group. Among these, preferred is an alcoholic hydroxyl group.

For the reactive modified polyester resin, amines are used as crosslinking agents, and a diisocyanate compound (diphenylmethane diisocyanate, etc.) is used as an elongating agent.

The amines act as crosslinking agents and elongating agents to the reactive modified polyester resin which is capable reacting with active hydrogen.

A modified polyester, such as a urea-modified polyester, which is obtained by reacting amines (B) with the polyester prepolymer (A) having an isocyanate group, as the reactive modified polyester resin, is advantageously used in that the molecular weight of the polymer components is easily controlled and physical properties of a dry process toner, in particular, oil-less low-temperature fixability can be surely obtained (extensive properties from releasing property to fixability can be secured with respect to a heat-fixing medium which has no release-oil applying mechanism).

Especially, a polyester prepolymer (A) whose terminal groups are urea-modified is preferably used in terms of its capability of suppressing adhesion to a heat-fixing medium while maintaining its high-flowability and transparency in the range of fixing temperature of the unmodified polyester resin itself.

A preferred polyester prepolymer (A) used in the present invention is a polyester prepolymer obtained by incorporating a polyester having on its terminal an active hydrogen, such as an acid group or a hydroxyl group, with a functional group such as an isocyanate group, which reacts with the active hydrogen.

A modified polyester (MPE) such as a urea-modified polyester can be derived from the prepolymer.

A modified polyester favorably used as a toner binder of the toner base particles is a urea-modified polyester obtained by reacting a polyester prepolymer (A) having an isocyanate group with amines (B) as crosslinking agents and/or elongating agents.

The polyester prepolymer (A) having an isocyanate group can be obtained by reacting further with a polyisocyanate (PIC) a polyester which is a polycondensate of a polyol (PO) and a polycarboxylic acid (PC) and has an active hydrogen-containing group.

Examples of the active hydrogen-containing group possessed by the polyester are a hydroxyl group (alcoholic hydroxyl group and phenolic hydroxyl group), an amino group, a carboxyl group and a mercapto group. Among these, preferred is an alcoholic hydroxyl group.

Examples of the polyols (PO) include diols (DIO) and trivalent or higher polyvalent polyols (TO), and a diol (DIO) singly or a mixture of a diol (DIO) and a small amount of a polyol (TO) is preferable. Examples of the diols (DIO) include alkylene glycols (ethylene glycol, 1,2-propylene glycol, 1,3-propylene glycol, 1,4-butanediol, 1,6-hexanediol, etc.); alkylene ether glycols (diethylene glycol, triethylene glycol, dipropylene glycol, polyethylene glycol, polypropylene glycol, polytetramethylene ether glycol, etc.); alicyclic diols (1,4-cyclohexane dimethanol, hydrogenated bisphenol A, etc.); bisphenols (bisphenol A, bisphenol F, bisphenol S, etc.); alkylene oxide (ethylene oxide, propylene oxide, butylene oxide, etc.) adducts of the above-mentioned alicyclic diols; and alkylene oxide (ethylene oxide, propylene oxide, butylene oxide, etc.) adducts of the above-mentioned bisphenols.

Among these, preferred are alkylene glycols having 2 to 12 carbon atoms and alkylene oxide adducts of bisphenols. Especially preferred are alkylene oxide adducts of bisphenols and a combination of an alkylene oxide adduct of a bisphenol and an alkylene glycol having 2 to 12 carbon atoms. Examples of the trivalent or higher polyvalent polyols (TO) include trivalent to octavalent or higher polyhydric aliphatic alcohols (glycerin, trimethylolethane, trimethylolpropane, pentaerythritol, sorbitol, etc.); trivalent or higher polyvalent phenols (trisphenol PA, phenol novolak, cresol novolak, etc.); and alkylene oxide adducts of the above-mentioned trivalent or higher polyvalent polyphenols.

Examples of the polycarboxylic acids (PC) include dicarboxylic acids (DIC) and trivalent or higher polyvalent polycarboxylic acids (TC), and a DIC singly or a mixture of a DIC and a small amount of a polycarboxylic acid (TC) are preferable. Examples of the dicarboxylic acids (DIC) include alkylene dicarboxylic acids (succinic acid, adipic acid, sebacic acid, etc.); alkenylene dicarboxylic acids (maleic acid, fumaric acid, etc.); and aromatic dicarboxylic acids (phthalic acid, isophthalic acid, terephthalic acid, naphthalenedicarboxylic acid, etc.).

Among these, preferred are an alkenylene dicarboxylic acid having 4 to 20 carbon atoms and an aromatic dicarboxylic acid having 8 to 20 carbon atoms. Examples of the trivalent or higher polyvalent polycarboxylic acids (TC) include aromatic polycarboxylic acids having 9 to 20 carbon atoms (trimellitic acid, pyromellitic acid, etc.).

The polycarboxylic acids (PC) may be obtained by reacting an acid anhydride of the above-mentioned polycarboxylic acid or a lower alkyl ester (methyl ester, ethyl ester, isopropyl ester, etc.) with a polyol (PO). The ratio of a polyol (PO) to a polycarboxylic acid (PC) in terms of the equivalent ratio (OH)/(COOH) of hydroxyl group (OH) to carboxyl group (COOH), is commonly 2/1 to 1/1, preferably 1.5/1 to 1/1, more preferably 1.3/1 to 1.02/1.

Examples of the polyisocyanates (PIC) include aliphatic polyisocyanates (tetramethylene diisocyanate, hexamethylene diisocyanate, 2,6-diisocyanatomethyl caproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); araliphatic diisocyanates ($\alpha,\alpha,\alpha',\alpha'$-tetramethylxylylene diisocyanate, etc.); isocyanurates; polyisocyanates obtained by blocking the above-mentioned polyisocyanates with a phenol derivative, an oxime, caprolactam or the like; and a combination of these two or more.

The ratio of a polyisocyanate (PIC) in terms of the equivalent ratio (NCO)/(OH) of isocyanate group (NCO) to hydroxyl group (OH) of a polyester having a hydroxyl group, is commonly 5/1 to 1/1, preferably 4/1 to 1.2/1, more preferably 2.5/1 to 1.5/1. When the ratio (NCO)/(OH) is more than 5, the low-temperature fixability degrades. With (NCO) of less than 1 in molecular ratio, in the case of using a modified polyester, the urea content in the ester decreases and the hot offset resistance degrades. The amount of a component constituting a polyisocyanate (PIC) in a prepolymer (A) having an isocyanate group at its terminals is commonly 0.5% by mass to 40% by mass, preferably 1% by mass to 30% by mass, more preferably 2% by mass to 20% by mass. With the amount of less than 0.5% by mass, the hot offset resistance degrades and there also arises a disadvantage in the simultaneous satisfaction of both the heat resistant storage stability and the low-temperature fixability. By contrast, with the amount of more than 40% by mass, the low-temperature fixability degrades.

The number of isocyanate groups contained in one molecule of the prepolymer (A) having isocyanate groups is commonly 1 or more, preferably 1.5 to 3 on average, more preferably 1.8 to 2.5 on average. With the number of isocyanate groups of less than 1, the molecular weight of a urea-modified polyester decreases and the hot offset resistance degrades.

Examples of the amines (B) include diamines (B1), trivalent or higher polyvalent polyamines (B2), aminoalcohols (B3), aminomercaptans (B4), amino acids (B5) and amines (B6) obtained by blocking the amino groups of B1 to B5. Examples of the diamines (B1) include aromatic diamines (phenylenediamine, diethyltoluenediamine, 4,4'-diaminodiphenylmethane, etc.); alicyclic diamines (4,4'-diamino-3,3'-dimethyldicyclohexylmethane, diaminecyclohexane, isophoronediamine, etc.); and aliphatic diamines (ethylenediamine, tetramethylenediamine, hexamethylenediamine, etc.). Examples of the trivalent or higher polyvalent polyamines (B2) include diethylenetriamine and triethylenetetramine. Examples of the aminoalcohols (B3) include ethanolamine and hydroxyethylaniline. Examples of the aminomercaptans (B4) include aminoethylmercaptan and aminopropylmercaptan. Examples of the amino acids (B5) include aminopropionic acid and aminocaproic acid. Examples of the amines (B6) obtained by blocking the amino groups of B1 to B5 include ketimine compounds obtained from the amines of B1 to B5 and ketones (acetone, methyl ethyl ketone, methyl isobutyl ketone, etc.), and oxazolidine compounds. Among these amines (B) preferred are a B1 and a mixture of a B1 and a small amount of a B2.

Further as required, the molecular weight of a polyester can be controlled using an elongation terminator. Examples of the elongation terminator include monoamines (diethylamine, dibutylamine, butylamine, laurylamine, etc.) and monoamines (ketimine compounds) obtained by blocking them.

The ratio of the amines (B) in terms of the equivalent ratio (NCO)/(NHx) of the isocyanate group (NCO) in a prepolymer (A) having isocyanate groups to the amino group (NHx) in the amines (B), is commonly 1/2 to 2/1, preferably 1.5/1 to 1/1.5, more preferably 1.2/1 to 1/1.2. With the ratio (NCO)/(NHx) of more than 2 and of less than 1/2, the molecular weight of the polyester decreases and the hot offset resistance may degrade.

The polyester resin (polyester) favorably used as a binder resin in the present invention is a urea-modified polyester (UMPE), but the polyester optionally contains a urethane bond with a urea bond.

The molar ratio of the urea bond content to urethane bond content is commonly 100/0 to 10/90, preferably 80/20 to 20/80, more preferably 60/40 to 30/70. With the molar ratio of urea bond of less than 10%, the hot offset resistance may degrade.

Modified polyesters such as urea-modified polyesters (UMPE) can be produced by the one-shot method or the like. Modified polyesters such as urea-modified polyesters (UMPE) commonly have a mass average molecular weight of 10,000 or more, preferably 20,000 to 10,000,000, more preferably 30,000 to 1,000,000. With the mass average molecular weight of less than 10,000, the hot offset resistance may degrade. The number average molecular weight of modified polyesters such as urea-modified polyesters (UMPE) in the case of using an unmodified polyester (PE) in combination, is not particularly limited and may be such a number average molecular weight that the above mass average molecular weight is easily obtained. The number average molecular weight in the case of using singly a modified polyester such as UMPE is commonly 2,000 to 15,000, preferably 2,000 to 10,000, more preferably 2,000 to 8,000.

With the number average molecular weight of more than 20,000, the low-temperature fixability may degrade, and in the case of use in a full-color machine (image forming apparatus), the glossiness of images obtained from the machine may degrade.

The modified polyester such as the above-mentioned polyester modified with a urea bond may be used alone or in combination with an unmodified polyester. The use of the modified polyester in combination with an unmodified polyester improves the low-temperature fixability, and the glossiness of images in the case of use in a full-color machine (image forming apparatus), and is more preferable than the single use.

Examples of the unmodified polyester include polycondensates of a polyol (PO) and a polycarboxylic acid (PC) similar to the polyester components of the above-mentioned UMPE, and preferable ones are similar to those of UMPE. The unmodified polyester has a mass average molecular weight (Mw) of 10,000 to 300,000, preferably 14,000 to 200,000. The number average molecular weight (Mn) is preferably 1,000 to 10,000, and more preferably 1,500 to 6,000. The unmodified polyester can be used not only in combination with an unmodified polyester, but also in combination with a polyester modified with a chemical bond other than urea bond, for example, a polyester modified with a urethane bond. It is preferable that the UMPE and the unmodified polyester be miscible at least partially with each other, in view of the low-temperature fixability and the hot offset resistance. Therefore, the polyester component of UMPE and the unmodified polyester preferably have analogous compositions. The mass ratio of UMPE to an unmodified polyester (PE) in the case of incorporation of PE is commonly 5/95 to 80/20, preferably 5/95 to 30/70, more preferably 5/95 to 25/75, especially preferably 7/93 to 20/80. With the mass ratio of UMPE of less than 5%, the hot offset resistance may degrade, and there also arises a disadvantage in the simultaneous satisfaction of both the heat resistant storage stability and the low-temperature fixability.

The unmodified polyester preferably has a hydroxyl value of 5 mg KOH/g or more, and preferably has an acid value of 1 mg KOH/g to 30 mg KOH/g, more preferably 5 mg KOH/g to 20 mg KOH/g.

Having an acid value easily exhibits the negative chargeability, and further has a favorable affinity between paper and a toner in fixing on a recording medium such as paper and improves the low-temperature fixability.

However, with the acid vale of more than 30 mg KOH/g, the stability of charging is likely to degrade especially in environmental variations. In the polymerization reaction, fluctuation of the acid value leads to fluctuation in the granulation (particle forming) process and makes the control in emulsification difficult.

The hydroxyl value of the unmodified polyester is measured according to the measurement method specified in JIS K0070-1966.

The glass transition temperature (Tg) of the binder resin is preferably 40° C. to 70° C., and more preferably 40° C. to 60° C. With the glass transition temperature (Tg) of lower than 40° C., the heat resistance of the resulting toner may degrade. With the Tg of higher than 70° C., the low-temperature fixability of the resulting toner may be insufficient.

The glass transition temperature (Tg) of the binder resin is measured by a differential scanning calorimeter (TG-DSC SYSTEM TAS-100, manufactured by Rigaku Industrial Corp.). The following gives a brief explanation of the measurement method of the glass transition temperature (Tg).

Firstly, 10 mg of a sample is incorporated in an aluminum sample container, the sample container is placed on a holder unit and set in an electric furnace. The sample is heated from room temperature to 150° C. at a temperature rising rate of 10° C./min, and allowed to stand at 150° C. for 10 minutes. Subsequently, the sample is cooled to room temperature and allowed to stand for 10 minutes. The sample is subjected to a DSC measurement in which the sample is heated to 150° C. again at a temperature rising rate of 10° C./min in nitrogen atmosphere. The Tg is determined from an intersection point of a tangent line of an endothermic curve adjacent to the Tg and a base line, using an analysis system in the TAS-100 system.

<Colorant>

The colorant is not particularly limited and may be suitably selected in accordance with the intended use. Specific examples of the colorant include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, colcothar, red lead oxide, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, and lithopone. These colorants may be used alone or in combination.

The amount of the colorant is preferably 1% by mass to 15% by mass, and more preferably 3% by mass to 10% by mass, with respect to the amount of the toner base particles used.

The colorant may be combined with a resin for use as a masterbatch. As a resin to be kneaded in production of a masterbatch or with a masterbatch, it is possible to use, for example, a binder resin used for the toner base particles.

Specific examples of the resin include modified polyester resins, unmodified polyester resins, styrenes such as polystyrene, poly-p-chlorostyrene, and polyvinyltoluene, and substituted polymers thereof; styrene copolymers such as a styrene-p-chlorostyrene copolymer, styrene-propylene copolymer, styrene-vinyltoluene copolymer, styrene-vinylnaphthaline copolymer, styrene-methylacrylate copolymer, styrene-ethylacrylate copolymer, styrene-butylacrylate copolymer, styrene-octyl acrylate copolymer, a styrene-methylmethacrylate copolymer, styrene-ethylmethacrylate copolymer, styrene-butylmethacrylate copolymer, styrene-α-chloromethylmethacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleate copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinylbutyral, polyacrylate resin, rosin, modified rosin, terpene resin, aliphatic or alicyclic hydrocarbon resin, aromatic petroleum resin, chlorinated paraffin, and paraffin wax. These may be used alone or in combination.

The masterbatch can be obtained by mixing and kneading the resin for masterbatch and the colorant under application of high shearing force. On that occasion, it is preferable to add an organic solvent to a mixture of the colorant and the resin so as to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a triple roll mill is preferably used.

<Wax>

As the wax, a wax having a low-melting point of 50° C. to 120° C. is preferably used from the viewpoint of the high-temperature offset resistance. Note that the melting point of the wax is a maximum endothermic peak temperature measured by a differential scanning calorimeter (DSC). As the differential scanning calorimeter, for example, a TG-DSC SYSTEM TAS-100 (manufactured by manufactured by Rigaku Industrial Corp.) can be used.

Specific examples of the wax include natural waxes: vegetable waxes such as carnauba wax, cotton wax, Japan wax, and rice wax; animal waxes such as bees wax, and lanolin; mineral waxes such as ozokerite, cerecine; and petroleum waxes such as paraffin, microcrystalline, and petrolatum; synthetic hydrocarbon waxes such as Fisher-Tropsh wax, and polyethylene wax; and synthetic waxes such as ester wax, ketone wax, and ether wax.

Further, the following may also be used: a fatty acid amide compound such as 12-hydroxy stearic acid amide, stearic acid amide, phthalic anhydride imide, and chlorinated hydrocarbon; a polyacrylate homopolymer or polyacrylate copolymer of low-molecular weight crystalline polymer resin, such as poly-n-stearyl methacrylate, and poly-n-lauryl methacrylate (e.g. a copolymer of n-stearyl acrylate-ethyl methacrylate, etc.); and a crystalline polymer having a long-chain alkyl group at its side chain, or the like.

The amount of the wax contained is preferably 2% by mass to 15% by mass with respect to the amount of the toner base particles used. With the amount of the wax of less than 2% by mass, the offset preventing effect may become insufficient, and with the amount of the wax of more than 15% by mass, the transferability and the durability of the resulting toner may degrade.

From the viewpoint of the transferability, durability and the like, the maximum dispersion particle size of the wax in the toner base particles is preferably 0.5 μm to 2.0 μm in major axis diameter. When the maximum dispersion particle size of the wax is shorter than 0.5 μm in major axis diameter, the wax hardly exudes to the surface of toner particles at the time of fixing, and the offset preventing effect may become insufficient.

The particle size of wax in the toner base particles can be determined by a circle area-corresponding number average particle diameter D (μm) of wax particles. The circle area-corresponding number average particle diameter D of the wax particles preferably satisfies the following relationship, $0.50\ \mu m < D < 0.70\ \mu m$.

The circle area-corresponding number average particle diameter D (μm) is adjusted in the course of production of toner base particles and determined from wax particles in a wax dispersion liquid.

The circle area-corresponding number average particle diameter D (μm) can be measured by a flow type particle image analyzer FPIA-3000S (manufactured by Sysmex Corporation).

Specifically, in a container from which impurity solids have been preliminarily removed, 100 ml to 150 ml of a dispersion solvent is poured, about 0.02 g to about 0.10 g of a measurement sample was added to the dispersion solvent, and the concentration of the measurement sample is adjusted to 5,000/μl to 10,000/μl. Based on the measurement sample whose concentration has been adjusted, the shape of wax particles in the measurement sample and a particle size distribution of wax particles are measured using the measurement device, and thereby the circle area-corresponding number average particle diameter D (μm) can be determined.

<Charge Controlling Agent>

The toner of the present invention optionally contains a charge controlling agent, as required.

The charge controlling agent is not particularly limited and may be suitably selected in accordance with the intended use. Examples of the charge controlling agent include nigrosine dyes, triphenylmethane dyes, chrome-containing metal complex dyes, molybdic acid chelate pigments, rhodamine dyes, alkoxy-based amines, quaternary ammonium salts (including fluorine-modified quaternary ammonium salt), alkylamides, a single substance of phosphorus or compound thereof, a single substance of tungsten or compound thereof, fluorochemical surfactants, salicylic acid metal salts, and metal salts of salicylic acid derivatives.

Specific examples of the charge controlling agents include BONTRON 03 of a nigrosine dye, BONTRON P-51 of a quaternary ammonium salt, BONTRON S-34 of a metal-containing azo dye, E-82 of an oxynaphthoic acid-based metal complex, E-84 of a salicylic acid-based metal complex, and E-89 of a phenolic condensate (produced by ORIENT CHEMICAL Co. Ltd.); TP-302 and TP-415 of a quaternary ammonium salt molybdenum complex (produced by HODOGAYA CHEMICAL Co., Ltd.); COPY CHARGE PSY VP2038 of a quaternary ammonium salt, COPY BLUE PR of a triphenyl methane derivative, COPY CHARGE NEG VP2036 of a quaternary ammonium salt, COPY CHARGE NX VP434 (produced by Hoechst AG); LRA-901 and LR-147 of a boron complex (produced by NIPPON CARLIT); copper phthalocyanine, perylene, quinacridone, and azo pigments; and other polymer compounds having a functional group such as sulfonic group, carboxyl group, quaternary ammonium salt or the like. These may be used alone or in combination.

The amount of the charge controlling agent is determined based on the toner production method employed, including the type of binder resin for toner base particles, the presence or absence of additives used as required and the dispersion method, and is not unequivocally defined, however, it is preferably 0.1 parts by mass to 10 parts by mass, and more preferably 0.2 parts by mass to 5 parts by mass relative to 100 parts by mass of the binder resin.

The amount of the charge controlling agent is more than 10 parts by mass, the effect of the charge controlling agent is reduced due to an excessively large chargeability, possibly leading to degradation in flowability of the developer and degradation in image density.

<Particle Diameter of Toner Base Particle>

The average particle diameter and a particle size distribution of toner base particles can be determined by the COULTER COUNTER method.

As a device for measuring a particle size distribution of toner base particles, COULTER COUNTER TA-II, and COULTER MULTISIZER II (both manufactured by Coulter Electronics Corp.) are exemplified.

In embodiments of the present invention, a COULTER COUNTER TA-II is connected to an interface (manufactured by The Institute of JUSE) and a PC9801 personal computer (manufactured by NEC Corporation) for outputting a number distribution and a volume distribution, to measure the average particle diameter and the particle size distribution. The following explains the measurement method.

Firstly, into 100 ml to 150 ml of an electrolysis aqueous solution, 0.1 ml to 5 ml of a surfactant (preferably, an alkylbenzene sulfonic acid salt) is added as a dispersant. The electrolysis aqueous solution is a 1% NaCl aqueous solution prepared using primary sodium chloride. For example, ISOTON-II (produced by Coulter Co.) can be used.

Subsequently, 2 mg to 20 mg of a measurement sample is added to the electrolysis aqueous solution. The electrolysis aqueous solution, in which the measurement sample has been added and suspended, is subjected to a dispersion treatment by a supersonic wave dispersing machine for about 1 minute to 3 minutes.

In the measurement device, a 100 μm aperture is used as the aperture. The volume and the number of particles of toner base particles are measured, and then a volume distribution and a number distribution are calculated.

The following 13 channels are used to measure particles having diameters of 2.00 μm or larger and smaller than 40.30 μm: a channel of 2.00 μm or larger and smaller than 2.52 μm, a channel of 2.52 μm or larger and smaller than 3.17 μm; a channel of 3.17 μm or larger and smaller than 4.00 μm; a channel of 4.00 μm or larger and smaller than 5.04 μm; a channel of 5.04 μm or larger and smaller than 6.35 μm; a channel of 6.35 μm or larger and smaller than 8.00 μm; a channel of 8.00 μm or larger and smaller than 10.08 μm; a channel of 10.08 μm or larger and smaller than 12.70 μm; a channel of 12.70 μm or larger and smaller than 16.00 μm; a channel of 16.00 μm or larger and smaller than 20.20 μm; a channel of 20.20 μm or larger and smaller than 25.40 μm; a channel of 25.40 μm or larger and smaller than 32.00 μm; and a channel of 32.00 μm or larger and smaller than 40.30 μm.

A volume average particle diameter (Dv) can be determined from the volume distribution, and a number average particle diameter (Dn) can be determined from the number distribution. From the volume average particle diameter (Dv) and the number average particle diameter (Dn), a ratio (Dv/Dn) can be determined.

The rate of particles having a particle diameter of 2 μm or smaller and the average circularity of toner base particles can be measured by a flow type particle image analyzer, FPIA-3000 (manufactured by Sysmex Corporation).

More specifically, in a container from which impurity solids have been preliminarily removed, 100 ml to 150 ml of water is poured, 0.1 ml to 0.5 ml of a surfactant (preferably, an alkylbenzene sulfonic acid salt) as a dispersant is added to the water, and about 0.1 g to about 0.5 g of a measurement sample was further added to the water to obtain an aqueous dispersion liquid. The aqueous dispersion, in which the measurement sample is suspended, is then subjected to a dispersion treatment by a supersonic wave dispersing machine for about 1 minute to 3 minutes. The concentration of the dispersion liquid is adjusted to 3,000/μl to 10,000/μl. The shape of the toner base particles and a particle size distribution of the toner base particles are measured using the measurement device, and thereby the rate of particles and the average circularity of the toner base particles can be determined.

The volume average particle diameter Dv of toner base particles of the toner is preferably 3.0 μm to 7.0 μm.

When the volume average particle diameter Dv of the toner base particles is smaller than 3.0 μm, in the case of use as a two-component developer, the toner is fused on the surface of a carrier due to long-term agitation in a developing device, which may cause a reduction in chargeability of the carrier. Further, in the case of use as a one-component developer, it is liable to cause toner filming onto a developing roller and a toner fusion onto a regulating member composed of a blade for forming a toner into a thin-layer, etc.

By contrast, when the volume average particle diameter Dv of the toner base particles is larger than 7.0 μm, a high-resolution and high-quality image may be difficult to obtain.

The ratio (Dv/Dn) of a volume average particle diameter (Dv) of the toner base particles to the number average particle diameter (Dn) is preferably 1.20 or less, more preferably in the range of 1.00 to 1.20, and still more preferably in the range of 1.00 to 1.15.

When the ratio (Dv/Dn) is in the range of 1.00 to 1.20, it is possible to obtain a toner capable of forming a high-resolution and high-quality image.

Especially when the toner is used for a two-component developer, the particle diameter of the toner hardly varies therein, even when consumption and supply of toner particles are repeated. Further, the toner has consistent developability even after being agitated in a developing device.

When the ratio (Dv/Dn) is more than 1.20, the particle diameter of individual toner particles (base particles) substantially varies to cause variations in toner behavior in developing process or the like, leading to impairment of reproducibility of the micro-dots, which may result in incapability of obtaining a high-quality image.

<External Additive>

As the external additive, inorganic fine particles are favorably used. The primary particle diameter of the inorganic fine particles is preferably in the range of 5 nm to 2 μm, and more preferably in the range of 5 nm to 500 nm. The specific surface area of the inorganic fine particles measured by the BET method is preferably in the range of 20 $m^2/g$ to 500 $m^2/g$.

The amount of the inorganic fine particles added to the toner base particles is preferably 0.01% by mass to 5% by mass, and more preferably 0.01% by mass to 2.0% by mass.

The inorganic fine particles are not particularly limited and may be suitably selected in accordance with the intended use. Examples of the inorganic fine particles include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride. These inorganic fine particles may be used alone or in combination.

(Developer)

The toner can be used in a two-component developer.

The two-component developer is prepared by mixing the electrostatic image developing toner and a magnetic carrier.

With respect to the ratio of the amounts of the carrier and the toner in the developer, the amount of the toner is preferably 1 part by mass to 10 parts by mass relative to 100 parts by mass of the carrier.

As the magnetic carrier, a known magnetic carrier can be used, such as an iron powder, a ferrite powder, a magnetite powder, a magnetic resin carrier each having a particle diameter of about 20 μm to about 200 μm.

As a covering material used for a surface layer of the carrier, amino resin, such as a urea-formaldehyde resin, a melamine resin, a benzoguanamine resin, a urea resin, a polyamide resin and an epoxy resin are exemplified. Specific preferred examples of usable resins for the surface layer of the carrier include, but are not limited to, polyvinyl and polyvinylidene resins such as acrylic resin, polymethyl methacrylate resin, polyacrylonitrile resin, polyvinyl acetate resin, polyvinyl alcohol resin, polyvinyl butyral resin; polystyrene resins such as polystyrene resin and styrene-acrylonitrile copolymer resin; halogenated olefin resins such as polyvinyl chloride; polyester resins such as polyethylene terephthalate resin and polybutylene terephthalate resin; polycarbonate resins, polyethylene resins, polyvinyl fluoride resins, polyvinylidene fluoride resins, polytrifluoroethylene resins, polyhexafluoropropylene resins, copolymers of vinylidene fluoride and an acrylic monomer, copolymers of vinylidene fluoride and vinyl fluoride, fluoroterpolymers such as terpolymers of tetrafluoroethylene, vinylidene fluoride and a non-fluorinated monomer, and silicone resins. These resins may be used alone or in combination.

The covering material optionally contains a conductive powder and the like, as required. Specific examples of usable conductive powers include, but are not limited to, metal powders, carbon black, titanium oxide, tin oxide, and zinc oxide. The conductive powder preferably has an average particle diameter of 1 μm or less. When the average particle diameter is larger than 1 μm, it becomes difficult to control the electric resistance.

Further, the electrostatic image developing toner can be used as a one-component magnetic toner using no carrier, and can also be used as a non-magnetic toner.

(Method for Producing Toner)

The method for producing a toner of the present invention is a method for producing an electrostatic image developing toner including toner base particles which contain at least a colorant, a binder resin and a wax, and the method includes a wax dispersion liquid preparation step, a precursor toner base particle forming step, and a toner base particle preparation step and further include other steps as required.

<Wax Dispersion Liquid Preparation Step>

In the wax dispersion liquid preparation step, a wax solution in which a wax is heated and dissolved or heated and dispersed in an organic solvent, is cooled in a container so that a standard deviation σ of a temperature distribution between a center portion of the container and the inner wall of the container is 0.5 or less and the cooling rate is 2.0° C./min or more, to precipitate wax particles in the wax solution, thereby obtaining a wax dispersion liquid.

—Preparation of Wax Solution—

The wax solution is used for the purpose of precipitating wax particles having a desired particle size. The wax solution is prepared by heating a wax in an organic solvent such as ethyl acetate, so as to be dissolved or dispersed therein.

The wax solution is cooled in a given container. FIG. 1 is an explanatory diagram schematically showing a container for cooling a wax solution.

A container 20 accommodates a wax solution in a bath part 22 enclosed with an inner wall 21. At a center portion of the container 20, an agitator rod 31 of an agitator 30 is set. The agitator rod 31 is provided with agitation paddles 32. The agitation paddles 32 are set so as to substantially make contact with the inner wall 21 of the container 20. In the present embodiment, the container 20 has a cylindrical shape.

In the present embodiment, the wax solution is cooled using the container 20. The rotational speed etc. of the agitation rod 31 of the agitator 30 provided in the container 20 is appropriately controlled to cool the wax solution so that a standard deviation σ of a temperature distribution obtained from the center portion of the container 20 to the inner wall 21 of the container 20 is 0.5 or less and the cooling rate is 2.0° C./min or more.

In a distance between the center portion of the container 20 and the inner wall 21, a temperature detecting unit 40 such as a thermocouple, a temperature sensor and a thermometer are arranged. As the temperature detecting unit 40, a plurality of units are arranged, for example, at equally-spaced intervals in the distance between the center portion to the inner wall 21.

In the present embodiment, the temperature detecting units 40 are respectively arranged at an A point close to the center portion of the container 20, a B point close to the inner wall 21, a C point bisecting a distance between the A point and B point, and a D point bisecting a distance between the C point and the B point.

It should be noted that in the present embodiment, the temperature detecting units 40 are arranged at a depth of about half the depth of the wax solution accommodated in the bath part 22 of the container 20.

The temperature distribution is monitored using a plurality of temperature detecting units 40. On that occasion, thermography or the like may be used so that the temperature of the entire system (the whole wax solution) can be monitored. The monitoring of the temperature distribution by thermography may be carried out simultaneously with monitoring by the temperature detecting units 40.

In particular, local reduction in temperature is liable to occur especially in the vicinity of the inner wall 21 of the container 20. Therefore, it is preferable that the temperature at that site be monitored intensively.

It is preferable that the agitator 30 be placed so that the tip portions of the agitation paddles 32 make contact with the inner wall 21 of the container 20.

There has been a disadvantage in that when a wax solution is cooled in a container, the wax solution at a portion contacted with the inner wall of the container is locally cooled to be precipitated on the inner wall of the container. When a wax is precipitated and a wax layer is formed on the inner wall of a container, the wax layer functions as a heat insulating material, and the wax solution is hardly locally cooled, resulting in great variations in the temperature distribution.

However, in the method of producing an electrostatic image developing toner of the present embodiment, a wax solution is cooled while controlling the temperature distribution of the wax solution using the agitator equipped with the agitation paddles, so that wax particles having a desired particle size can be precipitated.

In other words, in the wax dispersion liquid preparation step of the method for producing an electrostatic image developing toner of the present embodiment, at the time of heating a wax solution in a container so as to be dissolved or dispersed therein, it is possible to prevent the occurrence of wax precipitation, accompanied by a local temperature reduction caused by contact of the wax solution with the inner wall of the container. Therefore, it is possible to prevent nonuniform cooling due to the heat insulating effect brought about by the precipitation of a wax layer on the inner wall.

It is also possible to prevent nonuniform cooling brought about by convective flow inside the wax solution generated by the agitator.

In the present embodiment, wax particles precipitated has a circle area-corresponding number average particle diameter D satisfies the relationship, $0.50\ \mu m<D<0.70\ \mu m$.

<Precursor Toner Base Particle Forming Step>

In the precursor toner base particle forming step, an aqueous phase containing resin fine particles is added to an oil phase containing at least the wax dispersion liquid, a masterbatch containing a colorant and a binder resin, and the oil phase and the aqueous phase are mixed with each other, thereby forming toner base precursor particles which are precursors of toner base particles.

The oil phase is prepared by adding the wax dispersion liquid, a colorant and the like into an organic solvent such as ethyl acetate.

Resin fine particles contained in the aqueous phase to be added into the oil phase partially constitute the binder resin contained in the resulting toner base particles.

The resin fine particles are used for the purpose of controlling the shape (circularity, and particle distribution) of final toner base particles.

The resin fine particles are not particularly limited as long as the resin fine particles are made of a water-dispersible resin, and may be suitably selected in accordance with the intended use. A material of the resin fine particles may be a thermoplastic resin or thermosetting resin. Specific examples of the material include vinyl resins, polyurethane resins, epoxy resins, polyester resins, polyamide resins, polyimide resins, silicon resins, phenol resins, melamine resins, urea resins, aniline resins, ionomer resins, and polycarbonate resins. These resins may be used alone or in combination.

Among these, preferred are a vinyl resin, a polyurethane resin, an epoxy resin, a polyester resin and a combination thereof in terms that an aqueous dispersion of microscopic, spherically shaped resin particles can be easily obtained. Specific examples of the vinyl resin include polymers obtained by single polymerization or copolymerization of a vinyl monomer, such as a styrene-(meth)acrylic acid ester resin, a styrene-butadiene copolymer, a (meth)acrylic acid-acrylic acid ester copolymer, a styrene-acrylonitrile copolymer, a styrene-maleic anhydride copolymer, and a styrene-(meth)acrylic acid copolymer.

The amount of the resin fine particles is preferably 0.5% by mass to 5.0% by mass relative to the amount of the toner in which external additives are attached to the surface of toner base particles. When the amount of the resin fine particles is less than 0.5% by mass, the heat resistant storage stability of the toner degrades, and blocking is liable to occur during the storage of the toner and in a developing device. When the amount of the resin fine particles is more than 5.0% by mass, the resin fine particles inhibit exudation of wax component contained in the toner in fixation of toner, which makes it impossible to obtain releasability of toner and may cause hot-offset.

The amount of the resin fine particles contained in the toner can be measured by the following manner. A substance not derived from toner particles but derived from resin fine particles is analyzed by a pyrolysis-gas chromatography mass spectrometer, and the amount of the resin fine particles can be calculated from the peak area. A detector used in the analysis is preferably a mass spectrometer, but is not limited thereto. The dispersed and blended amount of the resin fine particle in an aqueous medium may be set so as to meet the requirements relating to the amount of the resin fine particle, and the dispersed and blended amount is typically about 0.5% by mass to about 10% by mass.

The glass transition temperature (Tg) of the resin fine particles is preferably 40° C. to 100° C., and the mass average molecular weight of the resin fine particles is preferably 9,000 to 200,000. When the Tg of the resin fine particles is lower than 40° C. and/or the mass average molecular weight is less than 9,000, the heat resistant storage stability of the toner degrades, which may cause blocking during the storage of the toner and in a developing device. When the Tg of the resin fine particles is higher than 80° C. and/or the mass average molecular weight is more than 200,000, the resin fine particles inhibit the adhesiveness of the toner to fixing paper in fixation of toner, and the fixing lower limit temperature may increase.

In the process of the preparation of the oil phase and preparation of the aqueous phase, the addition of the aqueous phase into the oil phase, and mixing them, know dispersing machines such as a low-speed shearing type dispersing device, a high-speed shearing type dispersing device, a friction-type dispersing device, a high-pressure jet type dispersing device and a ultrasonic wave dispersing device can be suitably used.

As a dispersant suitably used for emulsifying and dispersing the components in preparation of an oil phase, etc., the following surfactants can be used: anionic surfactants such as alkylbenzene sulfonic acid salts, α-olefin sulfonic acid salts, and phosphate ester; cationic surfactants of amine salts type such as alkyl amine salts, aminoalcohol fatty acid derivatives, polyamine fatty acid derivatives, and imidazoline, and of quaternary ammonium salts type such as alkyltrimethyl ammonium salts, dialkyldimethyl ammonium salts, alkyldimethylbenzyl ammonium salts, pyridinium salts, alkylisoquinolinium salts, and benzethonium chloride; nonionic surfactants such as fatty acid amide derivatives, and polyhydric alcohol derivatives; and amphoteric surfactants such as alanine, dedecyldi(aminoethyl)glycin, di(octylaminoethyl)glycin, and N-alkyl-N,N-dimethylammonium betaine.

A surfactant having a fluoroalkyl group can prepare a dispersion liquid having excellent dispersibility even when a small amount of the surfactant is used. Preferred examples of anionic surfactants having a fluoroalkyl group include fluoroalkyl carboxylic acids having from 2 to 10 carbon atoms and their metal salts, disodium perfluorooctane-sulfonylglutamate, sodium 3-{omega-fluoroalkyl(C6-C11)oxy}-1-alkyl(C3-C4)sulfonate, sodium 3-{omega-fluoroalkanoyl (C6-C8)-N-ethylamino}-1-propane sulfonate, fluoroalkyl (C11-C20) carboxylic acids and their metal salts, perfluoroalkylcarboxylic acids (C7-C13) and their metal salts, perfluoroalkyl (C4-C12) sulfonic acids and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethyl ammonium salts, salts of perfluoroalkyl(C6-C10)-N-ethylsulfonylglycin, monoperfluoroalkyl(C6-C16)ethylphosphates, etc.

Specific examples of trade names for the above include SURFLON S-111, S-112, and S-113 (Asahi Glass Co., Ltd.), FLORAD FC-93, FC-95, FC-98, and FC-129 (Sumitomo 3M), UNIDYNE DS-101 and DS-102 (DAIKIN INDUSTRIES, Ltd.), MEGAFAC F-110, F-120, F-113, F-191, F-812, and F-833 (Dainippon Ink & Chemicals Incorporated), ECTOP EF-102, 103, 104, 105, 112, 123A, 123B, 306A, 501, 201, and 204 (Tohchem Products Co., Ltd.), and FTERGENT F-100 and F150 (NEOS COMPANY LIMITED).

Examples of the cationic surfactants include primary, secondary and tertiary aliphatic amine acids having a fluoroalkyl group, aliphatic quaternary ammonium salts such as perfluoroalkyl(C6-C10)sulfone amide propyltrimethyl ammonium salts, benzalkonium salts, benzethonium chloride, pyridinium salts, imidazolinium salts, etc. Specific examples of trade names for the above include SURFLON S-121 (Asahi Glass Co., Ltd.), FLORAD FC-135 (Sumitomo 3M), UNIDYNE DS-202 (DAIKIN INDUSTRIES, Ltd.), MEGAFAC F-150 and F-824 (Dainippon Ink & Chemicals Incorporated), ECTOP EF-132 (Tohchem Products Co., Ltd.), and FTERGENT F-300 (NEOS COMPANY LIMITED).

As an inorganic compound dispersant sparsely soluble in water, tricalcium phosphate, calcium carbonate, titanium oxide, colloidal silica, and hydroxyapatite can be also be employed.

Further, it is possible to stabilize dispersion liquid droplets using a polymeric protection colloid. Specific usable examples of such protection colloids include acids such as acrylic acid, methacrylic acid, α-cyanoacrylic acid, α-cyanomethacrylic acid, itaconic acid, crotonic acid, fumaric acid, maleic acid and maleic anhydride; acrylic monomers having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylic acid esters, diethyleneglycol monomethacrylic acid esters, glycerin monoacrylic acid esters, N-methylolacrylamide and N-methylolmethacrylamide; vinyl alcohol and its ethers such as vinyl methyl ether, vinyl ethyl ether and vinyl propyl ether; esters of vinyl alcohol with a compound having a carboxyl group such as vinyl acetate, vinyl propionate and vinyl butyrate; acrylamide, methacrylamide and diacetoneacrylamide and their methylol compounds; acid chlorides such as acrylic acid chloride and methacrylic acid chloride; and homopolymers or copolymers having a nitrogen atom or a heterocyclic ring having a nitrogen atom such as vinyl pyridine, vinyl pyrrolidone, vinyl imidazole and ethylene imine; polyoxyethylene compounds such as polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters; and celluloses such as methyl cellulose, hydroxyethyl cellulose and hydroxypropyl cellulose.

<Toner Base Particle Preparation Step>

In the toner base particle preparation step, the solvent is removed from the toner base precursor particles to obtain toner base particles.

In the precursor toner baser particle forming step, in order to remove the organic solvent from an emulsified dispersion (toner base precursor particles) in an emulsified dispersion liquid obtained by mixing an oil phase and an aqueous phase, for example, a method is employed in which the temperature of the entire system is gradually raised so as to completely evaporate and remove the organic solvent in the liquid droplets.

At the time of removing the organic solvent, the system is agitated in a laminar flow under application of a strong agitation force at a constant temperature, and then the organic solvent is removed, and thereby spindle shaped toner base particles can be produced.

By applying a strong agitation force to the system at the time of removing the organic solvent, it is possible to control toner base particles so as to have a shape ranging from a spherical shape to a "rugby football shape". Further, with respect to the morphology of the surface, the toner base particles can be controlled ranging from a smooth surface to a dented, uneven surface (like pickled plum-shape).

When as a dispersion stabilizer, a dispersion stabilizer soluble in acid and alkali, such as calcium phosphate salt, is used, the calcium phosphate salt is dissolved in toner baser particles using an acid such as hydrochloric acid, and then the toner base particles are washed with water to thereby remove the calcium phosphate. Besides, the calcium phosphate can also be removed therefrom by a treatment such as resolution of enzyme.

The resulting toner base particles are subjected to a classification treatment as required, so as to have a desired particle size distribution. The classification treatment can be carried out in the dispersion liquid by means of a cyclone, a decanter, a centrifugal separator or the like. With this classification treatment, microparticle fractions can be removed.

Note that the toner base particles may be dried so as to be a dried powder before being subjected to a classification treatment.

(Image Forming Apparatus and Image Forming Method)

The following explains an image forming method using a toner which has bee produced by the method for producing a toner of the present invention, and an image forming apparatus capable of carrying out the image forming method.

Figure 2:
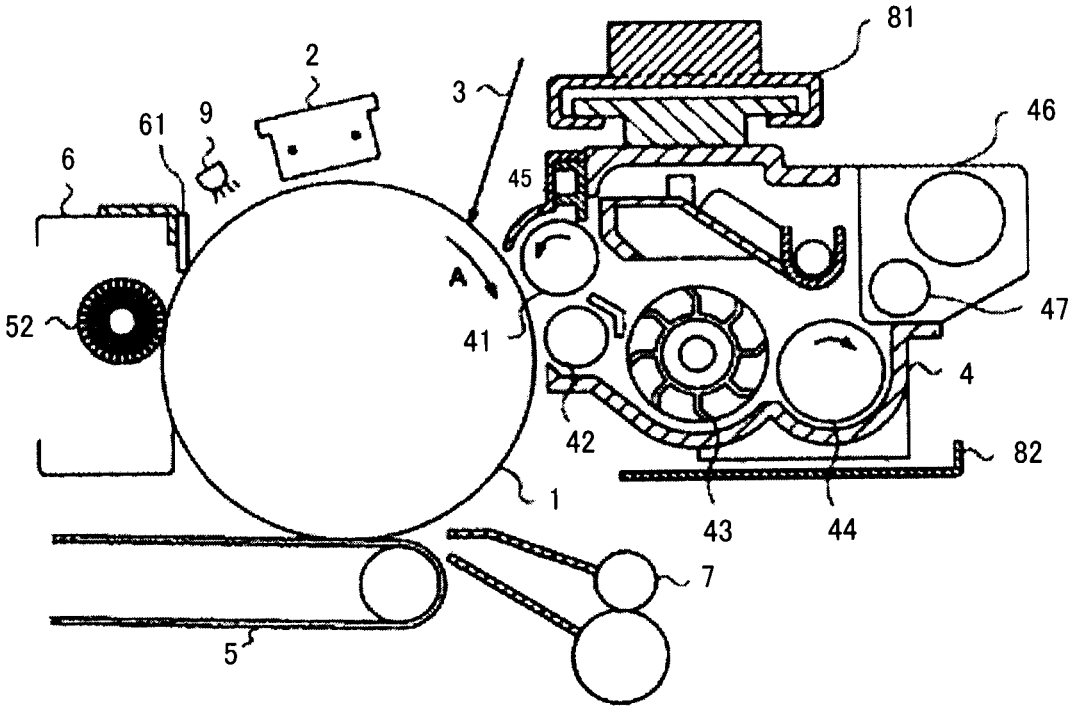
FIG. 2 is an explanatory diagram showing a cross-sectional example of an image forming apparatus used in the present invention.

FIG. 2 is an explanatory diagram showing a cross-sectional example of an image forming apparatus used in the present invention. Here, as the image forming apparatus, an electrophotographic copier is exemplarily illustrated. In FIG. 2, reference numeral 1 denotes a photoconductor drum as a latent image bearing member. The photoconductor drum 1 rotates in the direction indicated by an arrow A in FIG. 2.

On the periphery of the photoconductor drum 1, a charger 2 is provided. On a surface of the photoconductor drum 1, a laser beam 3 imagewise corresponding to image data read out from an original document is irradiated by an exposing unit.

Arranged around the photoconductor drum 1 are a developing device 4, a paper-feeding unit 7, a transfer device 5, a cleaning device 6 and a charge eliminating lamp 9.

The developing device 4 is provided with developing rollers 41 and 42, a paddle-shaped agitating unit 43, an agitating member 44, a doctor 45, a toner supplying unit 46 and a toner supplying roller 47.

The cleaning device 6 is provided with a cleaning brush 52, and a cleaning blade 61. Above and below the developing device 4, guide rails 81 and 82 for detachably mounting or supporting the developing device 4 are provided.

A toner produced by the method for producing a toner of the present invention can be favorably used in an image forming apparatus as illustrated in FIG. 2.

EXAMPLES

Hereinafter, Examples of the present invention will be described, which however shall not be construed as limiting the scope of the present invention. It should be noted that in the description below, "part" or "parts" means "part by mass" or "parts by mass", and "%" means % by mass.

Synthesis Example 1

Synthesis of Styrene-Acrylic Acid Copolymer 1

Into a vessel, 165 parts of a styrene monomer and 35 parts of n-butyl acrylate were added, the temperature of the components was raised to 60° C., and the components were mixed for 30 minutes and dissolved. Then, 8 parts of 2,2'-azobis(2,4-dimethylvaleronitrile) serving as a polymerization initiator was dissolved in the mixture, thereby synthesizing Styrene-Acrylic Acid Copolymer 1 as a polymerizable monomer composition.

Method for Producing a Toner

Example 1

Synthesis of Resin Fine Particle Emulsion

In a reaction vessel equipped with an agitation rod and a thermometer, 683 parts of water, 11 parts of a sodium salt of sulfate ester of methacrylic acid ethylene oxide adduct (ELEMINOL RS-30, available from Sanyo Chemical Industries, Ltd.), 80 parts of styrene, 83 parts of methacrylic acid, 110 parts of butyl acrylate, 12 parts of butyl thioglycolate and 1 part of persulfate ammonium were charged, and agitated at 400 rpm for 15 minutes to thereby obtain a white emulsified liquid.

The white emulsified liquid was heated until the temperature of the system was increased to 75° C. to react for 5 hours. Further, 30 parts of an aqueous solution of 1% ammonium persulfate was added to the reaction liquid, and aged at 75° C. for 5 hours to thereby obtain an aqueous dispersion liquid of a vinyl resin (a copolymer of sodium salt of sulfate ester of styrene-methacrylic acid-butyl acrylate-methacrylic acid ethylene oxide adduct). The aqueous dispersion liquid was referred to as [Microparticle Dispersion Liquid 1].

The volume average particle diameter of resin fine particles constituting a dispersion of the obtained [Microparticle Dispersion Liquid 1] was measured by a laser diffraction type particle size distribution measuring device (LA-920, manufactured by HORIBA Ltd.). The resin fine particles were found to have a volume average particle diameter of 120 nm.

A part of the [Microparticle Dispersion Liquid 1] was dried to isolate resin components. The isolated resin components were found to have a Tg (glass transition temperature) of 42° C. and a mass average molecular weight of 30,000.

<Preparation of Aqueous Phase>

In a given vessel, 990 parts of water, 65 parts of [Microparticle Dispersion Liquid 1], 37 parts of a 48.5% aqueous solution of dodecyl diphenyl ether disulfonic acid sodium (ELEMINOL MON-7 from Sanyo Chemical Industries, Ltd.) and 90 parts of ethyl acetate were mixed and agitated to obtain a milky white liquid [Aqueous Phase 1]

<Synthesis of Low-Molecular Weight Polyester>

In a reaction vessel equipped with a condenser, a stirrer and a nitrogen inlet tube, 229 parts of ethylene oxide 2 mol adduct of bisphenol A, 529 parts of propylene oxide 3 mol adduct of bisphenol A, 208 parts of terephthalic acid, 46 parts of adipic acid, and 2 parts of dibutyltin oxide were added. The mixture was subjected to a reaction for 8 hours at 230° C. under normal pressure, and subsequently reacted for 5 hours under a reduced pressure of from 10 mmHg to 15 mmHg. Further, 44 parts of trimellitic anhydride were added thereto, and the mixture was reacted for 2 hours at 180° C. under normal pressure. Thus a [low-molecular weight polyester 1] was obtained. The [low-molecular weight polyester 1] was found to have a number average molecular weight of 2,500, a mass average molecular weight of 6,700, a glass transition temperature (Tg) of 43° C., an acid value of 25 mgKOH/g and an SP value of 10.8.

<Synthesis of Intermediate Polyester>

In a reaction vessel equipped with a condenser, a stirrer and a nitrogen inlet tube, 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide were added. The mixture was subjected to a reaction for 8 hours at 230° C. under normal pressure, and subsequently reacted for 5 hours under a reduced pressure of from 10 mmHg to 15 mmHg. Thus [Intermediate Polyester 1] was obtained. The [Intermediate Polyester 1] was found to have a number average molecular weight of 2,100, a mass average molecular weight of 9,500, a glass transition temperature (Tg) of 55° C., an acid value of 0.5 mgKOH/g and a hydroxyl value of 51 mgKOH/g.

<Synthesis of Prepolymer>

In a reaction vessel equipped with a condenser, a stirrer and a nitrogen inlet tube, 410 parts of [Intermediate Polyester 1], 89 parts of isophorone diisocyante, and 500 parts of ethyl acetate were added, and the mixture was reacted at 100° C. for 5 hours to thereby obtain [Prepolymer 1] having an isocyanate group. The [Prepolymer 1] was found to have a free isocyanate group content of 1.53% by mass.

<Synthesis of Ketimine>

A reaction vessel equipped with a stirrer and a thermometer was charged with 170 parts of isophorone diamine and 75 parts of methyl ethyl ketone, and the mixture was reacted at 50° C. for 5 hours to obtain [Ketimine Compound 1]. The obtained [Ketimine Compound 1] was found to have an amine value of 418.

<Synthesis of Masterbatch>

Into a vessel, 1,200 parts of water, 40 parts of a carbon black (REAGAL 400R, produced by Cabot Corporation), and 60 parts of a polyester resin (RS801, produced by Sanyo Chemical Industries, Ltd.) were added, further 30 parts of water were added to the mixture and agitated by a HENSCHEL MIXER (manufactured by Mitsui Mining Co., Ltd.). The mixture was kneaded using two rolls at 150° C. for 30 minutes. Subsequently, the kneaded product was rolled and cooled, and then pulverized using a pulverizer to thereby obtain [Masterbatch 1].

<Preparation of Wax Dispersion Liquid>

In a cylindrical container as illustrated in FIG. 1 with an agitation rod being set at its center portion, thermometers were respectively set at a position near the agitation rod, a position near the cylindrical inner wall, at a position where a distance from the agitation rod to the inner wall was divided at 1:1, and at a position where the distance from the agitation rod to the inner wall was divided at 3:1.

The container was charged with 100 parts of [Low-Molecular Weight Polyester 1], 300 parts of a [Styrene-Acrylic Acid Copolymer 1 (SP value: 9.1)], 100 parts of a carnauba wax and 947 parts of ethyl acetate. The temperature of the mixture was increased to 80° C. while agitating, and the temperature of the mixture was maintained at 80° C. for 5 hours. Subsequently, while a temperature distribution being measured in every one minute, the mixture was cooled so that a standard deviation σ was 0.5 and the cooling rate was 2.0° C./min.

Subsequently, a wax was dispersed in the mixture using a bead mill (ULTRAVISCOMILL from AIMEX) under the following conditions: liquid feeding speed: 1 kg/hr; disc circumferential speed: 6 m/sec; filling factor of zirconia beads of 0.5 mm in size: 80% by volume; and the number of repeated dispersion treatments: 3 times. Thus [Wax Dispersion Liquid 1] was obtained.

The [Wax Dispersion Liquid 1] was found to have solids concentration of 40% (at 130° C., 30 min). A circle area-corresponding number average particle diameter D of wax dispersion particles contained in [Wax Dispersion Liquid 1] was measured by a flow-type particle image analyzer (FPIA-3000S, manufactured by Sysmex Corporation), and was found to be 0.60 μm.

<Preparation of Oil Phase>

A vessel equipped with a stirrer and a thermometer was charged with the above [Wax Dispersion Liquid 1], 500 parts of [Masterbatch 1], then charged with 500 parts of ethyl acetate, and the components were mixed for 1 hour to obtain [Material Solution Liquid 1].

To a vessel, 1,324 parts of [Material Solution Liquid 1] were transferred. Subsequently, 324 parts of a 65% ethyl acetate solution of [Low-Molecular Weight Polyester 1], and 1,000 parts of a 65% ethyl acetate solution of [Styrene-Acrylic Acid Copolymer 1] that had been obtained in Synthesis Example 1 were added to the vessel and dispersed therein using a bead mill (ULTRAVISCOMILL from AIMEX) under the following conditions: liquid feeding speed: 1 kg/hr; disc circumferential speed: 6 m/sec; filling factor of zirconia beads of 0.5 mm in size: 80% by volume; and the number of repeated dispersion treatments: once. Thus [Pigment/Wax Dispersion Liquid 1] was obtained.

<Emulsification>

Into a vessel, 648 parts of [Pigment/Wax Dispersion Liquid 1], 154 parts of [Prepolymer 1] and 8.5 parts of [Ketimine Compound 1] were added and mixed using a TK homomixer (manufactured by PRIMIX Corporation) at 5,000 rpm for 1 minute. Subsequently, 1,200 parts of [Aqueous Phase 1] were added to the vessel and mixed using the TK homomixer at 10,000 rpm for 20 minutes to obtain [Emulsified Slurry 1]. With this treatment, the oil phase was dispersed in the aqueous medium containing resin fine particles and an elongation reaction was carried out.

<Desolventation>

In a vessel equipped with a stirrer and a thermometer, the [Emulsified Slurry 1] was poured, and the [Emulsified Slurry 1] was subjected to desolventation treatment at 30° C. for 8 hours, and then aged at 45° C. for 4 hours to thereby obtain [Dispersion Slurry 1].

<Washing and Drying>

Next, 100 parts of [Dispersion Slurry 1] were filtered under reduced pressure, and the resulting filtration cake underwent the following steps:

(1) 100 parts by mass of ion exchanged water were added to the resulting filtration cake and mixed at 12,000 rpm for 10 minutes using a TK homomixer, followed by a filtration treatment.

(2) To the resulting filtration cake of (1), 100 parts of 10% sodium hydroxide aqueous liquid were added, mixed at 12,000 rpm for 30 minutes using a TK homomixer, and filtered under reduced pressure.

(3) To the resulting filtration cake of (2), 100 parts of 10% hydrochloric acid were added, mixed at 12,000 rpm for 10 minutes using a TK homomixer and then filtered.

(4) To the resulting filtration cake of (3), 300 parts of ion exchanged water were added, mixed at 12,000 rpm for 10 minutes using a TK homomixer, and then filtered. The above process was repeated two times, thereby obtaining a final filtration cake [Filtration Cake 1].

The [Filtration Cake 1] was dried with a circular air-drier at 45° C. for 48 hours and sieved with a mesh with openings of 75 μm to produce toner base particles [Toner Base Particles 1].

<External-Additive Treatment>

Relative to 100 parts of the obtained [Toner Base Particles 1], 0.7 parts of a hydrophobic silica and 0.3 parts of a hydrophobized titanium oxide as external additives were added, and the components were mixed using a HENSCHEL MIXER, thereby producing a toner [Toner 1].

<Measurement of Physical Properties>

(a) Particle Diameter

The particle diameter of [Toner 1] was measured by a particle size measuring device "COULTER COUNTER TA-II" manufactured by Coulter Electronics Corp., with an aperture diameter of 100 μm. The volume average particle diameter and the number average particle diameter of [Toner 1] were determined by a COULTER MULTISIZER II (manufactured by Coulter Electronics Corp.). The measurement results were shown in Table 1.

(b) Circularity

The average circularity of toner base particles was measured by a flow type particle image analyzer, FPIA-2100 (manufactured by Sysmex Corporation). More specifically, in 100 ml to 150 ml of water contained, in a container, from which impurity solids had been preliminarily removed, 0.1 ml to 0.5 ml of an alkylbenzene sulfonic acid salt as a dispersant was added to the water, and about 0.1 g to about 0.5 g of a measurement sample was further added thereto, and thus a suspension liquid was obtained. The suspension liquid was then subjected to a dispersion treatment by a supersonic wave dispersing machine for about 1 minute to 3 minutes so that the concentration of the dispersion liquid was adjusted to 3,000/μl to 10,000/μl. The average circularity of the toner was determined based on measurement results of the shape of the toner base particles and a particle size distribution which had been measured using the measurement device. The results are shown in Table 1.

[Preparation of Developer]

A two-component developer was prepared which was composed of 5% by mass of [Toner 1] and 95% by mass of a copper-zinc ferrite carrier having an average particle diameter of 40 μm with the surface of the carrier being covered with a silicone resin. The developer was set in a remodeled machine (which had been remodeled based on an IMAGIO COLOR 2800 manufactured by Ricoh Company Ltd. so as to allow evaluation of the developer, and an image was continuously printed. The developer was evaluated according to the following evaluation methods. The evaluation results and physical properties of [Toner 1] are shown in Table 1.

<Fixability>

Paper type 6200 produced by Ricoh Company Ltd. was set in a remodeled machine, in which a fixing unit of a copier, MF 2200 manufactured by Ricoh Company Ltd. using a TEFLON (Registered TM) roller as a fixing roller, had been remodeled, and a printing test was carried out using the remodeled machine. A cold offset temperature (a lower limit fixing temperature) and a hot offset temperature (a hot offset resistance temperature) were determined while varying the fixing temperature. The typical lower limit fixing temperature of a low-temperature fixable-toner is about 140° C. to about 150° C. Note that conditions for evaluation of the low-temperature fixability of toner were set as follows: paper-feeding linear velocity: 120 mm/sec to 150 mm/sec, contact pressure: 1.2 kgf/cm$^2$, and nip width: 3 mm; and conditions for evaluation of the high-temperature offset resistance were set as follows: paper-feeding linear velocity: 50 mm/sec; contact pressure: 2.0 kgf/cm$^2$; and nip width: 4.5 mm. The following gives evaluation criteria of the respective properties.

—Low-Temperature Fixability (Evaluated on 5 Grades)—

A: lower than 140° C.
B: 140° C. to 149° C.
C: 150° C. to 159° C.
D: 160° C. to 170° C.
E: 170° C. or higher —Hot Offset Resistance (Evaluated on 5 Grades)—

A: 201° C. or higher
B: 200° C. to 191° C.
C: 190° C. to 181° C.
D: 180° C. to 171° C.
E: 170° C. or lower —Heat Resistant Storage Stability—

After the toner being stored at 50° C. for 8 hours, the toner was sieved with a 42-mesh for 2 minutes, and the residual rate of toner remaining on the wire mesh was regarded as the heat-resistant storage stability of the toner. The more excellent in heat resistant storage stability the toner has, the smaller the residual rate becomes. The heat resistant storage stability of toner was evaluated on the following 4 grades.

D: 30% or more
C: 20% to 30%
B: 10% to 20%
A: less than 10%

Example 2

[Toner 2] was produced in a similar manner to that described in Example 1 except that [Wax Dispersion Liquid 2] was prepared while a temperature distribution being measured in every one minute and with varying the cooling rate, the mixture was cooled so that a standard deviation σ was 0.4 and the cooling rate was 2.5° C./min.

A circle area-corresponding number average particle diameter D of wax dispersion particles contained in [Wax Dispersion Liquid 2] was measured by a flow-type particle image analyzer (FPIA-3000S, manufactured by Sysmex Corporation), and was found to be 0.59 μm.

Subsequently, the particle diameter and the circularity of [Toner 2] were measured in similar manners to those described in Example 1. Further, [Toner 2] was used to prepare a two-component developer in a similar manner to that described in Example 1, followed by evaluation on the fixability and the heat resistant storage stability of the developer. The evaluation results are shown in Table 1.

Example 3

[Toner 3] was produced in a similar manner to that described in Example 1 except that [Wax Dispersion Liquid 3] was prepared while a temperature distribution being measured in every one minute and with varying the cooling rate, the mixture was cooled so that a standard deviation σ was 0.3 and the cooling rate was 2.2° C./min.

A circle area-corresponding number average particle diameter D of wax dispersion particles contained in [Wax Dispersion Liquid 3] was measured by a flow-type particle image analyzer (FPIA-3000S, manufactured by Sysmex Corporation), and was found to be 0.59 μm.

Subsequently, the particle diameter and the circularity of [Toner 3] were measured in similar manners to those described in Example 1. Further, [Toner 3] was used to prepare a two-component developer in a similar manner to that described in Example 1, followed by evaluation on the fixability and the heat resistant storage stability of the developer. The evaluation results are shown in Table 1.

Example 4

[Toner 4] was produced in a similar manner to that described in Example 1 except that [Wax Dispersion Liquid 4] was prepared while a temperature distribution being measured in every one minute and with varying the cooling rate, the mixture was cooled so that a standard deviation σ was 0.2 and the cooling rate was 2.0° C./min.

A circle area-corresponding number average particle diameter D of wax dispersion particles contained in [Wax Dispersion Liquid 4] was measured by a flow-type particle image analyzer (FPIA-3000S, manufactured by Sysmex Corporation), and was found to be 0.61 μm.

Subsequently, the particle diameter and the circularity of [Toner 4] were measured in similar manners to those described in Example 1. Further, [Toner 4] was used to prepare a two-component developer in a similar manner to that described in Example 1, followed by evaluation on the fixability and the heat resistant storage stability of the developer. The evaluation results are shown in Table 1.

Comparative Example 1

[Toner 5] was produced in a similar manner to that described in Example 1 except that [Wax Dispersion Liquid 5] was prepared while a temperature distribution being measured in every one minute and with varying the cooling rate, the mixture was cooled so that a standard deviation σ was 0.6 and the cooling rate was 2.7° C./min.

A circle area-corresponding number average particle diameter D of wax dispersion particles contained in [Wax Dispersion Liquid 5] was measured by a flow-type particle image analyzer (FPIA-3000S, manufactured by Sysmex Corporation), and was found to be 0.70 μm.

Subsequently, the particle diameter and the circularity of [Toner 5] were measured in similar manners to those described in Example 1. Further, [Toner 5] was used to prepare a two-component developer in a similar manner to that described in Example 1, followed by evaluation on the fixability and the heat resistant storage stability of the developer. The evaluation results are shown in Table 1.

Comparative Example 2

[Toner 6] was produced in a similar manner to that described in Example 1 except that [Wax Dispersion Liquid 6] was prepared while a temperature distribution being measured in every one minute and with varying the cooling rate, the mixture was cooled so that a standard deviation σ was 0.2 and the cooling rate was 1.8° C./min.

A circle area-corresponding number average particle diameter D of wax dispersion particles contained in [Wax Dispersion Liquid 6] was measured by a flow-type particle image analyzer (FPIA-3000S, manufactured by Sysmex Corporation), and was found to be 0.75 μm.

Subsequently, the particle diameter and the circularity of [Toner 6] were measured in similar manners to those described in Example 1. Further, [Toner 6] was used to prepare a two-component developer in a similar manner to that described in Example 1, followed by evaluation on the fixability and the heat resistant storage stability of the developer. The evaluation results are shown in Table 1.

Comparative Example 3

[Toner 7] was produced in a similar manner to that described in Example 1 except that [Wax Dispersion Liquid 7] was prepared while a temperature distribution being measured in every one minute and with varying the cooling rate, the mixture was cooled so that a standard deviation σ was 0.7 and the cooling rate was 1.9° C./min.

A circle area-corresponding a number average particle diameter D of wax dispersion particles contained in [Wax Dispersion Liquid 7] was measured by a flow-type particle image analyzer (FPIA-3000S, manufactured by Sysmex Corporation), and was found to be 0.80 μm.

Subsequently, the particle diameter and the circularity of [Toner 7] were measured in similar manners to those described in Example 1. Further, [Toner 7] was used to prepare a two-component developer in a similar manner to that described in Example 1, followed by evaluation on the fixability and the heat resistant storage stability of the developer. The evaluation results are shown in Table 1.

TABLE 1

| | | Wax particles | Particle size distribution of toner | | | | | | | |
|---|---|---|---|---|---|---|---|---|---|---|
| | | Circle | Volume | Number | | | Fixability | | | |
| | Sample | area-corresponding number average particle diameter D (μm) | average particle diameter Dv (μm) | average particle diameter Dn (μm) | Dv/Dn | Shape of toner Circularity | Lower limit fixing temperature | Hot offset resistance | Heat resistant storage stability | Overall evaluation |
| Ex. 1 | Toner 1 | 0.60 | 5.2 | 4.6 | 1.14 | 0.966 | A | A | C | A |
| Ex. 2 | Toner 2 | 0.59 | 5.0 | 4.5 | 1.12 | 0.963 | A | B | C | A |
| Ex. 3 | Toner 3 | 0.59 | 5.1 | 4.6 | 1.11 | 0.965 | A | A | C | A |
| Ex. 4 | Toner 4 | 0.61 | 5.2 | 4.6 | 1.13 | 0.962 | B | A | C | B |
| Comp. Ex. 1 | Toner 5 | 0.70 | 6.1 | 5.0 | 1.22 | 0.952 | D | D | C | C |
| Comp. Ex. 2 | Toner 6 | 0.75 | 7.1 | 6.1 | 1.16 | 0.956 | E | D | C | C |
| Comp. Ex. 3 | Toner 7 | 0.8 | 7.3 | 5.8 | 1.25 | 0.953 | D | E | C | C |

What is claimed is:

1. A method for producing a toner which comprises toner base particles containing at least a colorant, a binder resin and a wax, the method comprising:

heating a wax in an organic solvent to obtain a solution or dispersion of the wax in the organic solvent;

cooling the organic solvent solution or dispersion to prepare a wax dispersion liquid having wax particles;

adding a colorant and a binder resin to the wax dispersion liquid to obtain an oil phase;

adding an aqueous phase containing resin fine particles to the oil phase;

mixing the oil phase and the aqueous phase; and removing the solvent to obtain the toner base particles;

wherein the cooling of the organic solvent solution or dispersion is conducted in a container so that a standard deviation σ of a temperature distribution between a center portion of the container and an inner wall of the container is 0.5 or less and a cooling rate is 2.0° C./min or more.

2. The method for producing a toner according to claim 1, wherein the cooling of the organic solvent solution or dispersion of the wax is conducted in a container having an agitator provided with agitation paddles which constantly make contact with an inner wall of the container.

3. The method for producing a toner according to claim 1, wherein a circle area-corresponding number average particle diameter D of the wax particles obtained by the cooling is from 0.50 μm to 0.70 μm.

4. The method for producing a toner according to claim 1, wherein a volume average particle diameter Dv of the toner base particles is 3.0 μm to 7.0 μm.

5. The method for producing a toner according to claim 1, wherein a ratio Dv/Dn of a volume average particle diameter Dv of the toner base particles to a number average particle diameter Dn of the toner base particles is 1.20 or less.

6. The method for producing a toner according to claim 1, wherein the binder resin comprises a polyester resin.

7. The method for producing a toner according to claim 6, wherein an amount of the polyester resin contained in the binder resin is from 50% by mass to 98% by mass.

8. The method for producing a toner according to claim 6, wherein the polyester resin comprises tetrahydrofuran-soluble matter and a mass average molecular weight of the tetrahydrofuran-soluble matter is from 1,000 to 30,000.

9. The method for producing a toner according to claim 6, wherein the polyester resin comprises acid groups, and an acid value of the polyester resin is from 1.0 mgKOH/g to 50.0 mgKOH/g.

10. The method for producing a toner according to claim 9, wherein a glass transition temperature of the polyester resin is from 35° C. to 65° C.

11. The method for producing a toner according to claim 1, wherein a precursor of the binder resin comprises a polymer having sites capable of reacting with a compound having an active hydrogen-containing group, and a mass average molecular weight of the polymer is from 3,000 to 20,000.

12. The method for producing a toner according to claim 1, wherein an acid value of the toner base particles is from 0.5 mg KOH/g to 40.0 mg KOH/g.

13. The method for producing a toner according to claim 1, wherein a glass transition temperature of the toner base particles is from 40° C. to 70° C.

14. The method for producing a toner according to claim 1, wherein a melting point of the wax is from 50° C. to 120° C.

15. The method for producing a toner according to claim 1, wherein the wax is at least one selected from the group consisting of carnauba wax, cotton wax, Japan wax, rice wax, bees wax, lanolin, ozokerite, cerecine, a paraffin, a microcrystalline petroleum wax, a petrolatum wax, a Fisher-Tropsh wax, a polyethylene wax, an ester wax, a ketone wax, and an ether wax.

16. The method for producing a toner according to claim 1, wherein a content of the wax in the toner base particle is from 2% to 15% by mass.

* * * * *

UNITED STATES PATENT AND TRADEMARK OFFICE

CERTIFICATE OF CORRECTION

PATENT NO. : 8,546,053 B2
APPLICATION NO. : 12/555378
DATED : October 1, 2013
INVENTOR(S) : Teruki Kusahara et al.

It is certified that error appears in the above-identified patent and that said Letters Patent is hereby corrected as shown below:

Title Page: item (75), Third Inventor: "Namazu" should read -- Numazu --

Signed and Sealed this
Twenty-eighth Day of January, 2014

Michelle K. Lee

Michelle K. Lee
*Deputy Director of the United States Patent and Trademark Office*